US007523845B2

(12) United States Patent
Eberhardt

(10) Patent No.: US 7,523,845 B2
(45) Date of Patent: Apr. 28, 2009

(54) CAP FOR AN AEROSOL CONTAINER OR A SPRAY CONTAINER

(75) Inventor: Heiko Eberhardt, Oberursel (DE)

(73) Assignee: The Procter & Gamble Company, Cincinnati, OH (US)

( * ) Notice: Subject to any disclaimer, the term of this patent is extended or adjusted under 35 U.S.C. 154(b) by 426 days.

(21) Appl. No.: 11/304,331

(22) Filed: Dec. 15, 2005

(65) Prior Publication Data

US 2007/0007309 A1 Jan. 11, 2007

(30) Foreign Application Priority Data

Dec. 16, 2004 (DE) ..... 10 2004 060 491

(51) Int. Cl.
*B65D 83/00* (2006.01)

(52) U.S. Cl. ..... 222/402.13; 239/337

(58) Field of Classification Search ..... 222/182, 222/402.1–402.25; 239/337
See application file for complete search history.

(56) References Cited

U.S. PATENT DOCUMENTS 3,199,741 A * 8/1965 Lehmann ..... 222/402.13
3,282,471 A * 11/1966 Lehmann ..... 222/182
4,187,963 A * 2/1980 Mascia ..... 222/402.13
6,004,056 A * 12/1999 De Laforcade ..... 401/190
6,866,169 B2 * 3/2005 Blanck et al. ..... 222/402.13
2004/0140328 A1 * 7/2004 Pericard et al. ..... 222/402.13

FOREIGN PATENT DOCUMENTS

| | | | |
|---|---|---|---|
| EP | 0669268 | A1 | 8/1995 |
| FR | 1556668 | A | 2/1969 |
| GB | 1469729 | A | 4/1977 |
| JP | 2001088877 | A | 4/2001 |
| WO | WO-01/96210 | A2 | 12/2001 |

OTHER PUBLICATIONS

International Search Report for PCT/US2005/045536, Apr. 19, 2006 (6 pages).

* cited by examiner

*Primary Examiner*—Lien T Ngo
(74) *Attorney, Agent, or Firm*—Laura R. Grunzinger; Idris N. McKelvey; Marianne Dressman

(57) ABSTRACT

In order to acoustically seal a spray cap, a cap 7 is provided with a button 6 having an elastic connection 49 between button 6 and cap 7 in order to achieve an acoustic seal 49 of cap 7. In this context, seal 49 is designed as a crimped device. A hinge 5 of button 6 is formed in an analogously crimped manner in order to be able to actuate it together with seal 49 in a smooth-running manner.

14 Claims, 3 Drawing Sheets

CAP FOR AN AEROSOL CONTAINER OR A SPRAY CONTAINER

The invention relates to a cap for a container, especially an aerosol container or a spray container, having a button for manually actuating and dispensing product located in the container, e.g. hair spray, from a product discharge opening of the cap.

Sealing a cap of this type in order to achieve a pleasant spray noise while product is being discharged is known from WO 01/96210. In this case the button acts against a stem (product discharge tube) of the container via a 90° offset spray conduit in order to deflect the stem by manual actuation of the button and to thereby open a valve located in the container, whereupon the product contained in the container exits through the stem, the spray conduit and a product discharge opening provided on the cap. A flexible connection between the button and the cap provides an acoustic sealing of the cap. The button is joined to the cap in a monolithic manner.

A swiveling button that is formed as one piece together with the cap and without any hinge has a circumferential crimp as a seal between the cap and the button is known from European patent 0669268 A1. When the button is actuated, the crimp is always stretched on one side while it is compressed on the opposite side.

The known caps have the disadvantage that they are not provided for a greater smooth-running button deflection. They can be used for this, but only when a relatively large amount of manual force is applied.

The object of the present invention is to further develop a cap as described in the introductory clause of Claim 1 in such a manner that even greater button deflections may be carried out in a simple manner.

The object is achieved in that the hinge has a bellows or crimp corresponding to the seal.

The proposed hinge, which is crimped corresponding to the seal, has the advantage that it is possible to press the button down more smoothly, the hinge having a mechanical property corresponding to the seal. The crimped device in this context extends between the button and the housing of the cap and continues in the hinge. Depending on the required actuation travel, this device has a certain number of folds that is appropriate for this section, the crimped device, for example, always opening up somewhat downward and the upward return of the button resulting in a reversal of this opening movement. The hinge is not deflected very much. However, it is technically and visually adapted to the seal. It is very easy to actuate.

The crimped device may be mounted on the outer rim of the button and likewise on a circumferential, top rim of the cap. In an advantageous embodiment (claim 2) the button [sic] is round, e.g. oval or circular, and surrounds the button in an annular manner. The actuation force is minimized in this version.

An especially good acoustic seal and, thus, a pleasant spray noise is achieved if the seal, which is designed as a crimped device, hermetically seals the area between the cap and the button (Claim 8). In this context, the button and the device may form the top face of the cap so that the button is integrated into a normal appearance of the cap.

If the seal is designed as a bellows (Claim 3), then relatively long actuation paths of the button are achievable while comparatively little manual force is applied. However, a single circumferential button may also be used to implement the seal (Claim 4). Depending on the actuation travel, it is sized in order to provide a sealing of the cap when the button is actuated.

The manufacturing effort for the entire cap, together with the button, is comparatively little and therefore economical if the seal is joined to the cap and the button in a monolithic design (Claim 5). Thus, an individual part may be produced by a method that itself is known, e.g. by the injection molding process. However, the seal could also be designed as a separate component that is insertable as a plug-in connection between the cap and the button (Claim 6). This embodiment is appropriate, for example, for caps (spray caps) that were manufactured in a way known in and of itself and that are to undergo an acoustic sealing between cap and button.

The button may be joined to the area of the product discharge opening via a hinge (Claim 7). When it is actuated, product, e.g. hair spray, is sprayed out of the product discharge opening.

If the spray conduit is formed as a spray bracket that is joined to the cap in the area of the product discharge opening (Claim 9), then it is possible to swivel it by actuating the button in a lever function and, thus, relatively smoothly relative to the cap in order to open a valve located in the container.

In order to be able to evenly and smoothly press a button that is joined to the cap via a hinge, it is advantageous if the material thickness of the seal in the area of the product discharge opening is less than the material thickness in the area of the seal that is the most distant from the product discharge opening (Claim 10). In this context, the longest path of a point on the rim of the button is covered at the point where the material thickness is at a minimum. The greatest material thickness for sealing the gap between the button and the cap is used where the least button deflection occurs. From the perspective of manufacturing technique, it is advantageous, and an even, smooth manual actuation is achieved, if the material thickness of the seal from the area of the product discharge opening, especially from a hinge of the button, to the area far away from the opening continually increases between 0 and 180 degrees and gradually falls between 180 and 360 degrees (Claim 11). Very good button properties regarding an even and smooth button actuation are achieved if the material thickness of the seal in the area adjacent to the product discharge opening is between 0.4 and 0.6 mm and in the area far away from the opening is between 0.1 and 0.2 mm (Claim 12).

Elastic plastics, such as soft and flexible polypropylene (PP) or comparable polyethylene (PE), are suitable as material for the seal (Claim 13).

In principle, the cap together with the seal and the button are made in one piece out of plastic, e.g. a two-component plastic (Claim 14).

The invention is described in detail below with reference to an exemplary embodiment. In the drawing.

Figure 1:
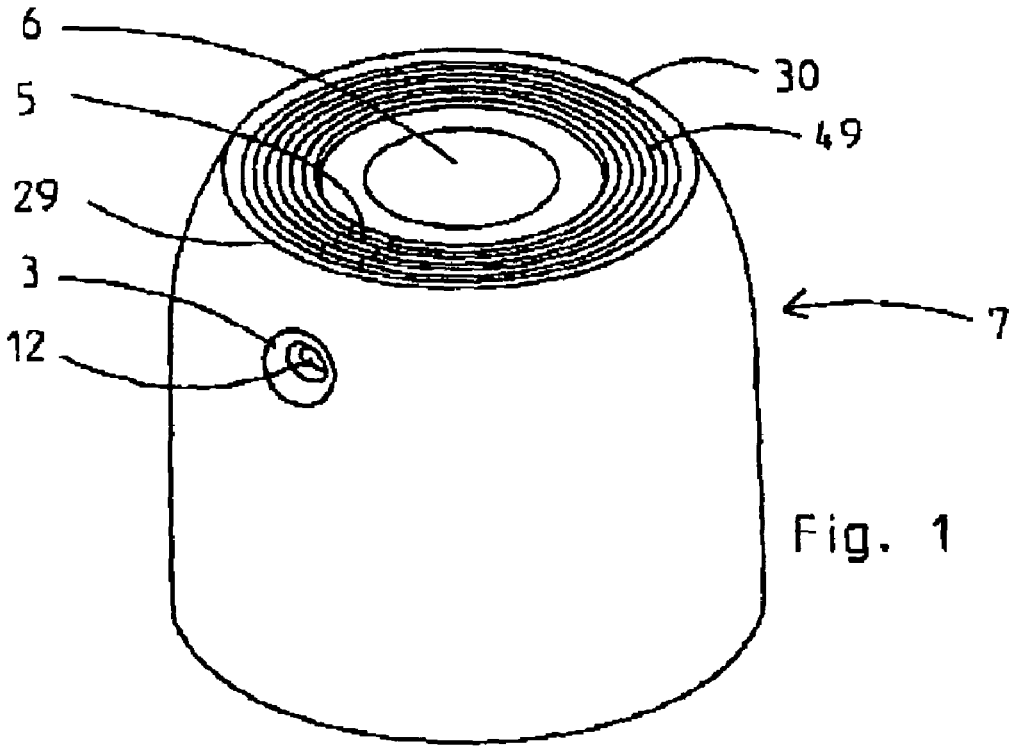
FIG. 1 shows a cap having a round button provided with a circumferential seal for placement on an aerosol container in a perspective view, a hinge of the button being crimped just like the seal.
Figure 2:
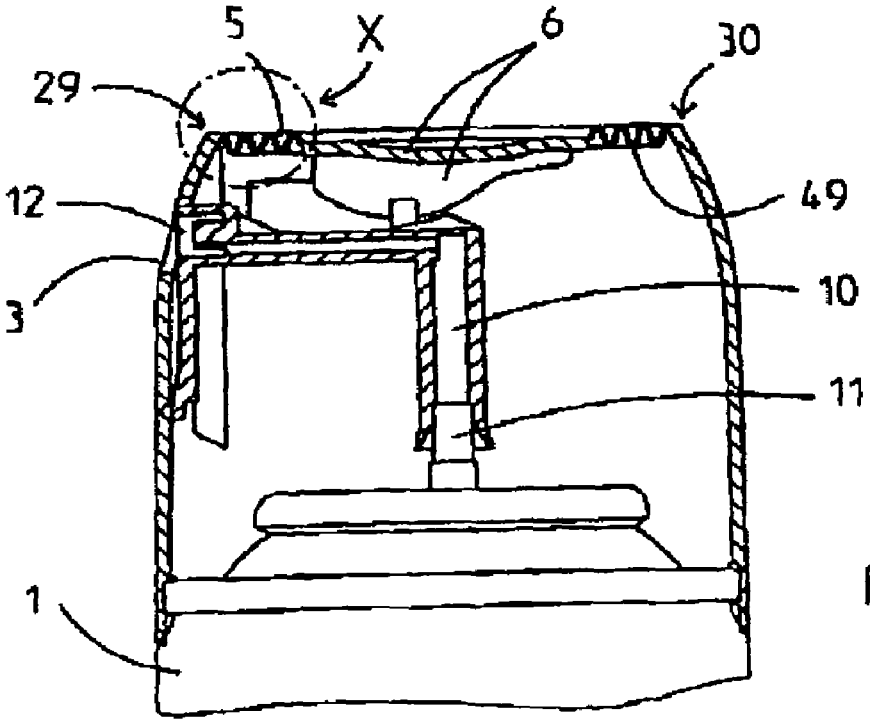
FIG. 2 shows the cap of FIG. 1 placed on a container, with the button unactuated, in a vertical section.
Figure 3:
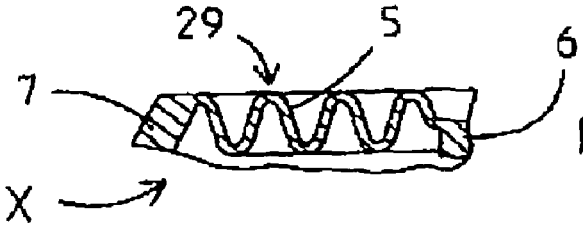
FIG. 3 is a detail X that shows the seal, which is designed as a bellows, between the cap and the button of the article of FIG. 2 in a vertical section.
Figure 4:
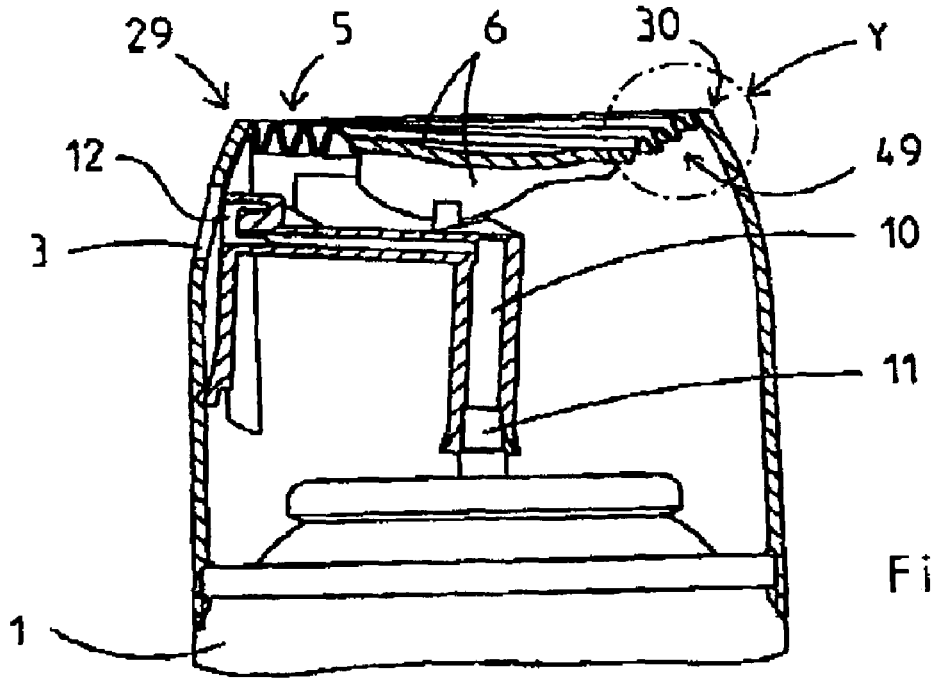
FIG. 4 shows the article of FIG. 2, but with the button pressed, in a vertical section.
Figure 5:
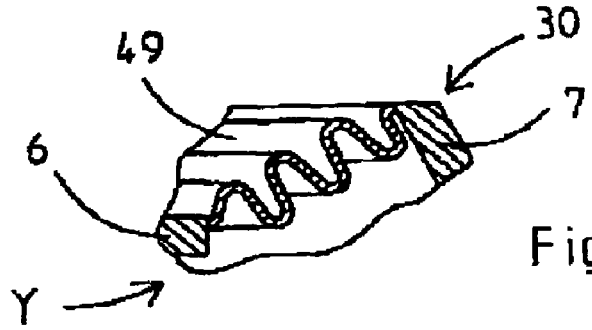
FIG. 5 shows a detail Y of FIG. 4 in a vertical section.
Figure 6:
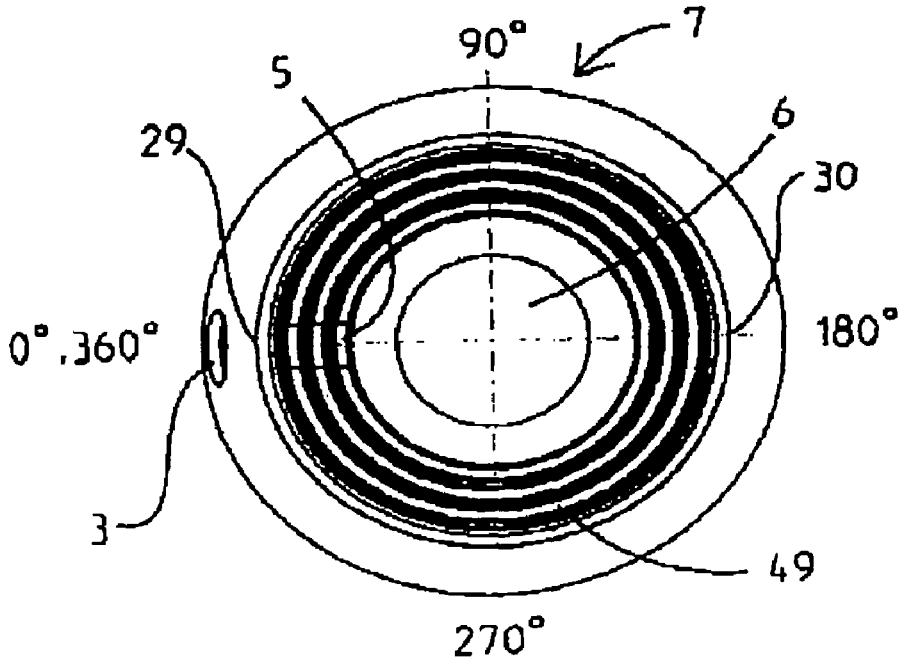
FIG. 6 shows the article of FIG. 1 in a top view.
Figure 7:
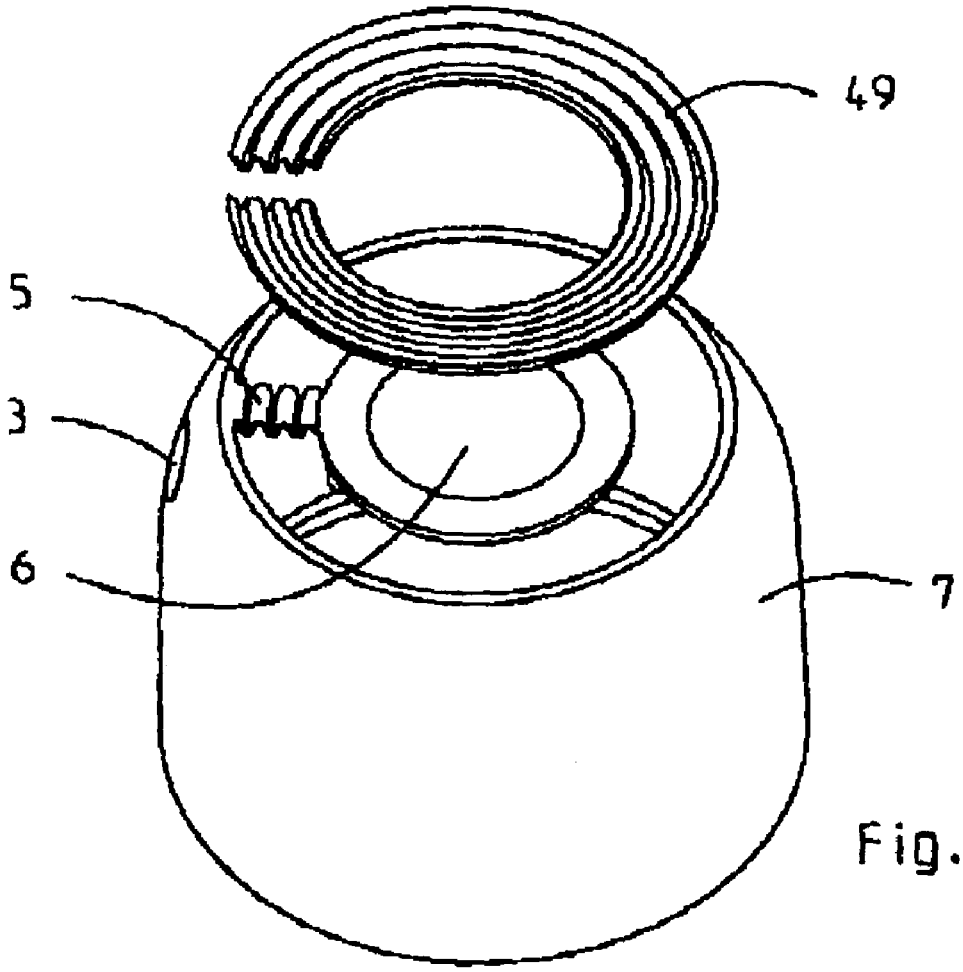
FIG. 7 shows the cap with the button joined via the hinge in a perspective view, an insertable bellows being provided for the purpose of being inserted between the button and the cap in order to seal the gap between the button and the cap.
Figure 8:
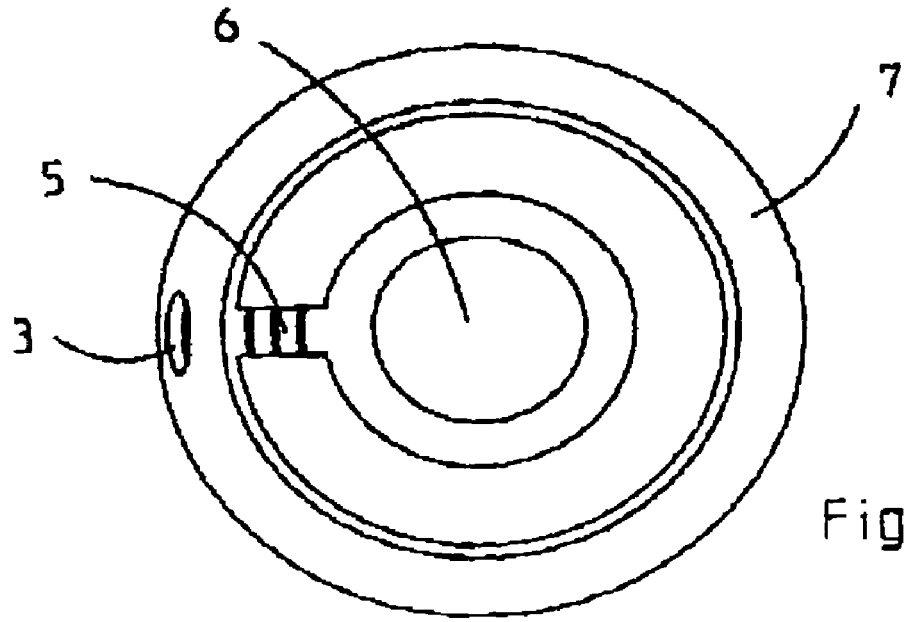
FIG. 8 shows the cap of FIG. 7 in a top view.

In a spray cap that has a cap 7, a button 6 is used for actuating a valve (not shown) of a container 1, which is designed as an aerosol container and contains hair spray. Button 6 is provided to act against a stem 11 of container 1 via a 90° offset spray conduit in order to deflect stem 11 when button 6 is manually actuated and, thus, open the valve, whereupon product contained in container 1 exits through stem 11 and a product discharge opening 3 provided on cap 7 while passing through spray conduit 10. In this context, a flexible connection 49 between the button and cap 7 functions as an acoustic seal 49 of cap 6 in order to achieve a spray sound that is pleasant for a customer. Seal 49 is designed as a crimped device in the form of a bellows.

The button has a round shape, and seal 49 surrounds button 6 in an annular manner. It hermetically seals the area between cap 7 and button 6.

Cap 7 together with hinge 5 and button 6 is made as one piece out of relatively hard polypropylene (PP). Moreover, cap 7 is joined to button 6 via seal 49. The spray cap also has a plastic for the seal that contains soft and flexible polyethylene (PE).

The material thickness of seal 49 in area 29 above product discharge opening 3 is less than the material thickness in area 30 of seal 49, which is furthest away from product discharge opening 3, that is, on the opposite end of button 6. In this context, the material thickness of seal 49 steadily increases from area 29 of product discharge opening 3 to the far away area 30, that is, from 0 to 180 degrees, and decreases steadily from 180 degrees to 360 degrees. The material thickness of seal 49 in this context is at a maximum 0.5 mm and at a minimum 0.15 mm.

Spray conduit 10 is formed as a spray bracket that is joined to cap 7 below product discharge opening 3.

However, in the area of crimped hinge 5, the crimp of seal 49 could have less height, even at the same material thickness, than at area 30, which is far away from hinge 5, because the button deflection is greater at area 30.

Seal 49 is designed as a separate component that is insertable between cap 7 and button 6. This variant is also suitable for spray caps in which, disadvantageously, a seal 49 still needs to be inserted after its manufacture.

The cap has the advantage that a low manual force is needed to actuate button 6 and thereby stretch the entire circumferential crimped device. When button 6 is released, seal 49 is restored to its original crimped state. The convolution of hinge 5 corresponds to the convolution of seal 49. This therefore achieves, on the one hand, an attractive visual impression and, on the other hand, a very smooth manual actuation of button 6. The crimped hinge 5 is relatively easy to deflect. Even after more frequent actuation, it cannot break, even if it is very thinly configured for the purpose of achieving a low operating force.

1 Container
3 Product discharge opening
5 Hinge for 6
6 Button
7 Cap
10 Spray conduit
11 Stem
12 Nozzle
29 Area around 3
30 Area, at a distance from 3
49 Seal All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cap (7) comprising a button (6) for the actuation of a valve of a container (1), especially of an aerosol container or spray container, the button (6) being connected via a hinge (5) to the cap (7) and also being provided for to act against a separate, 90° offset connector piece, especially a 90° offset spray conduit (10), and, thus, against a stem (11) of the container (1) in order to deflect the stem (11) when the button (6) is manually actuated and thereby open the valve, whereupon product contained in the container (1) can escape through the stem (11) and a product discharge opening (3) provided on the cap (7) while passing through the spray channel (10), a flexible connection between the button (6) and the cap (7) being an acoustic seal (49) of the cap (6), and the button (6) together with the hinge (5) and the cap (7) being made as one piece, the acoustic seal (49) being inserted as a separate compound from the button (6), hinge (5) and cap (7) one piece, wherein the hinge (5) has a bellows corresponding to the seal (49) or a crimp corresponding to the seal (49).

2. A cap according to claim 1, wherein the button (6) has a round, preferably circular or oval shape, and the seal (49) surrounds the button (6) in an annular manner.

3. A cap according to claim 1, wherein, the seal (49) is designed as a bellows.

4. A cap according to claim 1, wherein the seal (49) comprises a circumferential, single crimp.

5. A cap according to claim 1, wherein the seal (49) is connected in a one-piece design to the cap (7) and the button (6).

6. A cap according to claim 1, wherein the seal (49) is designed as a separate component that is insertable between the cap (7) and the button (6).

7. A cap according to claim 1, wherein the button (6) is joined via a hinge (5) to the area (29) of the cap (7).

8. A cap according to claim 1, wherein the seal (49) hermetically seals the area between the cap (7) and the button (6).

9. A cap according to claim 1, wherein the spray conduit (10) is formed as a spray bracket that is joined to the cap (7) in the area of the product discharge opening (3).

10. A cap according to claim 9, wherein the material thickness of the seal (49) in the area (29) of the product discharge opening (3) is less than the material thickness in the area (30) of the seal (49), which is the furthest away from the product discharge opening (3).

11. A cap according to claim 2, wherein the material thickness of the seal (49) from the area (29) of the product discharge opening (3) to the distant area (30) steadily increases between 0 and 180 degrees and steadily decreases between 180 and 360 degrees.

12. A cap according to claim 10, wherein the material thickness of the seal (49) in the area (29) adjacent to the product discharge opening (3) is between 0.4 and 0.6 mm and in the area at a distance (30) is between 0.1 and 0.2 mm.

13. A cap according to claim 1, wherein the seal (49) is made of an elastic plastic, such as soft and flexible polypropylene (PP) or polyethylene (PE).

14. A cap according to claim 1, wherein the cap (7) is made of a two-component plastic.

* * * * *